US008251486B2

(12) United States Patent
Oki

(10) Patent No.: US 8,251,486 B2
(45) Date of Patent: Aug. 28, 2012

(54) LIQUID EJECTING APPARATUS

(75) Inventor: Narihiro Oki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 803 days.

(21) Appl. No.: 11/852,090

(22) Filed: Sep. 7, 2007

(65) Prior Publication Data

US 2008/0284822 A1 Nov. 20, 2008

(30) Foreign Application Priority Data

Sep. 8, 2006 (JP) ..... 2006-244719

(51) Int. Cl.
*B41J 2/165* (2006.01)

(52) U.S. Cl. ..... 347/31

(58) Field of Classification Search ..... None
See application file for complete search history.

(56) References Cited

U.S. PATENT DOCUMENTS 5,285,354 A * 2/1994 Ohsawa et al. ..... 361/752
5,883,653 A * 3/1999 Sasaki ..... 347/86
2006/0187264 A1* 8/2006 Endo ..... 347/55

FOREIGN PATENT DOCUMENTS

JP 2004-202867 7/2004

* cited by examiner

*Primary Examiner* — Matthew Luu
*Assistant Examiner* — Alejandro Valencia
(74) *Attorney, Agent, or Firm* — Maschoff Gilmore & Israelsen

(57) ABSTRACT

A liquid ejecting apparatus includes a liquid ejecting head, a platen, an absorption member, an electrode, and a potential difference generating device. The liquid ejecting head has a conductive nozzle plate that ejects liquid toward a front face of a recording object. The platen is arranged at a position opposed to the nozzle plate with the recording object placed between the platen and the nozzle plate. The absorption member is arranged at a position opposed to the nozzle plate and located farther from openings of the nozzle plate than the recording object in a direction in which the liquid is ejected. The potential difference generating device generates a difference in potential between the nozzle plate and the electrode by applying voltage to the electrode so as to form an electric field, whereby liquid ejected from the liquid ejecting head is electrically attracted toward the electrode.

9 Claims, 17 Drawing Sheets

LIQUID EJECTING APPARATUS

BACKGROUND

1. Technical Field

The present invention relates to a liquid ejecting apparatus. More specifically, the invention relates to a liquid ejecting apparatus that adheres liquid, which is discharged from openings of a nozzle plate mounted on a liquid ejecting head, to a recording object.

2. Related Art

When a liquid ejecting apparatus adheres liquid to a recording object without any remaining margin at the periphery of the recording object, the liquid ejecting apparatus ejects liquid toward an area slightly larger than the size of the recording object in view of an inevitable positional deviation between the recording object and a liquid ejecting head. Thus, liquid is also ejected toward an area where the recording object is not present in proximity to the side peripheries and front and rear peripheries of the recording object. Then, an absorption member is arranged at a position opposed to the liquid ejecting head and located farther from the liquid ejecting head than the recording object, and the absorption member absorbs liquid that has been ejected but not adhered to the recording object. This prevents a stain from adhering to around the recording object due to liquid that has not adhered to the recording object.

In the meantime, when liquid is adhered to a recording object, the recording object may possibly form wrinkles because a portion to which the liquid is adhered may possibly expand. If the wrinkles contact the absorption member, liquid that has been absorbed by the absorption member stains the recording object. Then, in most of the liquid ejecting apparatuses, in view of the heights of wrinkles formed in the recording object, a clearance of about 2 to 4 mm is provided between the recording object and the absorption member. For the same purpose of preventing a stain due to contact, a clearance of about 1 mm is provided between the nozzle plate and the recording object. Thus, about 3 to 5 mm clearance is provided between the nozzle plate and the absorption member.

On the other hand, for the purpose of improving resolution of an image that is formed on the recording object by liquid, liquid droplets discharged from the openings of the nozzle plate tend to become finer and finer. When focusing on a single liquid droplet, the amount of the liquid droplet is only about a few picoliter. These fine liquid droplets each have an extremely small weight, so that, when the liquid droplets are once discharged from the nozzle plate, they rapidly lose their kinetic energy due to the viscous drag of the atmosphere, or the like. For example, it has been proved that liquid droplets having an amount of less than 8 picoliter lose their velocity to substantially zero when they fly a distance of about 3 mm in the atmosphere. The fine liquid droplets that have thus lost kinetic energy need a relatively long time until they complete falling because falling motion due to gravitational acceleration becomes substantially equal to a viscous drag force of the atmosphere. Liquid droplets float in the air until they complete falling. These liquid droplets are termed as aerosols.

Some of the thus produced aerosols float to the outside of the liquid ejecting apparatus and adhere to a peripheral area. In addition, most of the aerosols adhere to portions within the liquid ejecting apparatus. When the aerosol adhere to a path, such as a platen, along which a recording object is transported, a recording object that will be transported for the next time is stained because the aerosols adhere again to the next recording object. Further, when the aerosols are adhered to an electrical circuit, a linear scale, a rotary encoder, an optical sensor, or the like, which are mounted in the liquid ejecting apparatus, it may cause malfunction of the liquid ejecting apparatus itself. Furthermore, when a user touches the portions to which the aerosols are adhered, user's hand will be smeared with the aerosols.

Japanese Unexamined Patent Application Publication No. 2004-202867 describes a liquid ejecting apparatus that has the function of actively collecting aerosols using an electric field. In the liquid ejecting apparatus described therein, for the purpose of adhering and absorbing liquid droplets that have not adhered to a recording object, an absorption member is arranged at a position opposed to a nozzle plate. In addition, a metal component, which serves as a first electrode, is arranged on the surface of the absorption member, and a metal nozzle plate having openings for ejecting liquid is used as a second electrode.

When these electrode and nozzle plate are applied with different voltages, an electric field is generated therebetween. On the other hand, liquid droplets discharged from the nozzle plate, at the moment when the liquid droplets are discharged from the nozzle plate, will be charged with the same pole as that of the nozzle plate owing to a so-called lightning rod effect. Thus, fine liquid droplets, which may become aerosols, also continue flying toward the electrode without any deceleration owing to Coulomb attraction from the electric field and are then adsorbed by the electrode having an electric potential that is opposite in pole to those of their own electric charge. Furthermore, liquid droplets that are adsorbed by the electrode are absorbed by the absorption member, which is arranged in proximity to the electrode, by the action of capillarity.

As described above, it has been proved that it is possible to suppress production of aerosols by means of an electric field utilizing the aerosols being electrically charged. However, in the liquid ejecting apparatus having the above described function, there is another technical problem to be solved because of the structure that the electrodes are arranged in a space between the nozzle plate and the platen, in which the space is physically restricted in layout.

That is, the clearance between the nozzle plate, which ejects liquid, and the recording object is preferably smaller within a range in which the nozzle plate and the recording object do not contact each other. Thus, a platen that supports the recording object to that position is also arranged in proximity to the nozzle plate. In addition, the absorption member accommodated in the platen is also preferably arranged in proximity to the nozzle plate within a range in which the absorption member does not contact the recording object. For this reason, a space that is left just below the nozzle plate is extremely small.

On the other hand, when the electrode, which is arranged in proximity to the absorption member, is directly opposed to the nozzle plate, liquid may adhere to the electrode, and an electric field formed between the nozzle plate and the electrode thereby may possibly vary. Then, the electrode is arranged behind the absorption member relative to the nozzle plate and, as a result, the electrode may be extended outside from the accommodation portion of the platen. However, as described above, because the clearance between the nozzle plate and the platen is small, a component, when passed over the side wall of the accommodation portion of a platen body, interferes with the nozzle plate. For this reason, a structure is employed in which the side wall of the accommodation portion has a cutout portion formed therein and a component that connects the electrode to an external is passed through the cutout portion.

However, since the side wall has a low height at a portion where the cutout portion is formed, when liquid absorbed by the absorption member increases, ink may overflow outside through the cutout portion. Because liquid contains electrolyte and thus has conductivity, a short circuit may occur when liquid that has overflown to the outside of the platen adheres to a component having an electrical function, such as the electrode. Moreover, because most types of liquid promote corrosion of a metal component, it is undesirable that liquid adheres to the metal component.

SUMMARY

A first aspect of the invention provides a liquid ejecting apparatus. The liquid ejecting apparatus includes a liquid ejecting head, a platen, an absorption member, an electrode, a potential difference generating device. The liquid ejecting head has a conductive nozzle plate that has openings. The liquid ejecting head ejects liquid from the openings toward a front face of a recording object. The platen is arranged at a position opposed to the nozzle plate with the recording object placed between the platen and the nozzle plate. The platen contacts a rear face of the recording object to support the recording object. The absorption member is arranged at a position opposed to the nozzle plate and located farther from the openings than the recording object in a direction in which the liquid is ejected. The absorption member absorbs liquid that is ejected from the openings but not adhered to the recording object. The electrode is arranged in proximity to the absorption member. The potential difference generating device generates a difference in potential between the nozzle plate and the electrode by applying voltage to the electrode so as to form an electric field, whereby liquid ejected from the liquid ejecting head is electrically attracted toward the electrode. The platen includes a platen body, an accommodation portion, a cutout portion, and a blocking member. The accommodation portion is depressed from the platen body and formed to include a bottom portion and a side wall portion. The accommodation portion accommodates the absorption member therein. The cutout portion is formed in the side wall portion. The cutout portion allows the electrode, which is arranged along the bottom portion of the accommodation portion, to pass therethrough when the electrode is taken out from an inside of the accommodation portion to an outside of the accommodation portion. The blocking member blocks liquid that flows out from the inside of the accommodation portion to the outside of the accommodation portion through a gap between an inner face of the cutout portion and the electrode. This prevents liquid from flowing out from a specific portion of the accommodation portion of the platen and also prevents the liquid from adhering to the inside of the liquid ejecting apparatus. Accordingly, this also prevents an electrical failure due to adhesion of liquid and degradation of metal components.

In the above liquid ejecting apparatus, the blocking member may be a dam member that fills the gap between the inner face of the cutout portion and the electrode. In this manner, it is possible to prevent liquid from flowing out with a simple structure.

Further, in the above liquid ejecting apparatus, the blocking member may be an additional absorption member that is arranged in proximity to the gap between the inner face of the cutout portion and the electrode, wherein the additional absorption member absorbs and holds liquid that has flown out from the gap. In this manner, it is possible to prevent a large amount of liquid from flowing out for a long time. In addition, because the outflow liquid is held in the additional absorption member, there is no possibility that an unexpected failure occurs.

In the above liquid ejecting apparatus, one end of the platen may be arranged in proximity to the gap between the inner face of the cutout portion and the electrode, and the other end of the platen may be arranged in proximity to the additional absorption member, wherein the platen may further include a liquid guiding portion that guides liquid that flows out from the gap, to the additional absorption member. In this manner, it is possible to reliably guide the outflow liquid to the additional absorption member.

In the above liquid ejecting apparatus, the liquid guiding portion may be formed of a porous material, wherein the liquid guiding portion guides liquid by the action of capillarity. In this manner, it is possible to easily form a structure that guides liquid to the additional absorption member through a desired path.

In the above liquid ejecting apparatus, the liquid guiding portion may be a guide groove that is formed in the platen body. In this manner, without adding any members, it is possible to reliably guide liquid to the additional absorption member through a desired path.

In the above liquid ejecting apparatus, the additional absorption member may be electrically insulated from a portion having a potential that is different from a potential of the electrode in a state where the additional absorption member holds the liquid. This prevents fluctuation in potential of the electrode through the outflow liquid, so that a stable electric field is formed.

In the above liquid ejecting apparatus, the electrode may be attached so that the gap is placed closer to the additional absorption member. In this manner, it is possible to guide liquid to the additional absorption member with a short path length.

Note that the above overview of the aspects of the invention is not intended to describe all necessary features of the invention. Accordingly, the sub-combinations of these sets of features may also be aspects of the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will now be described, but the following embodiments are not intended to limit the scope of the invention as set forth in the appended claims. In addition, it is not always necessary to include all the combinations of the features described in the embodiments for solution of the aspects of the invention.

Figure 1:
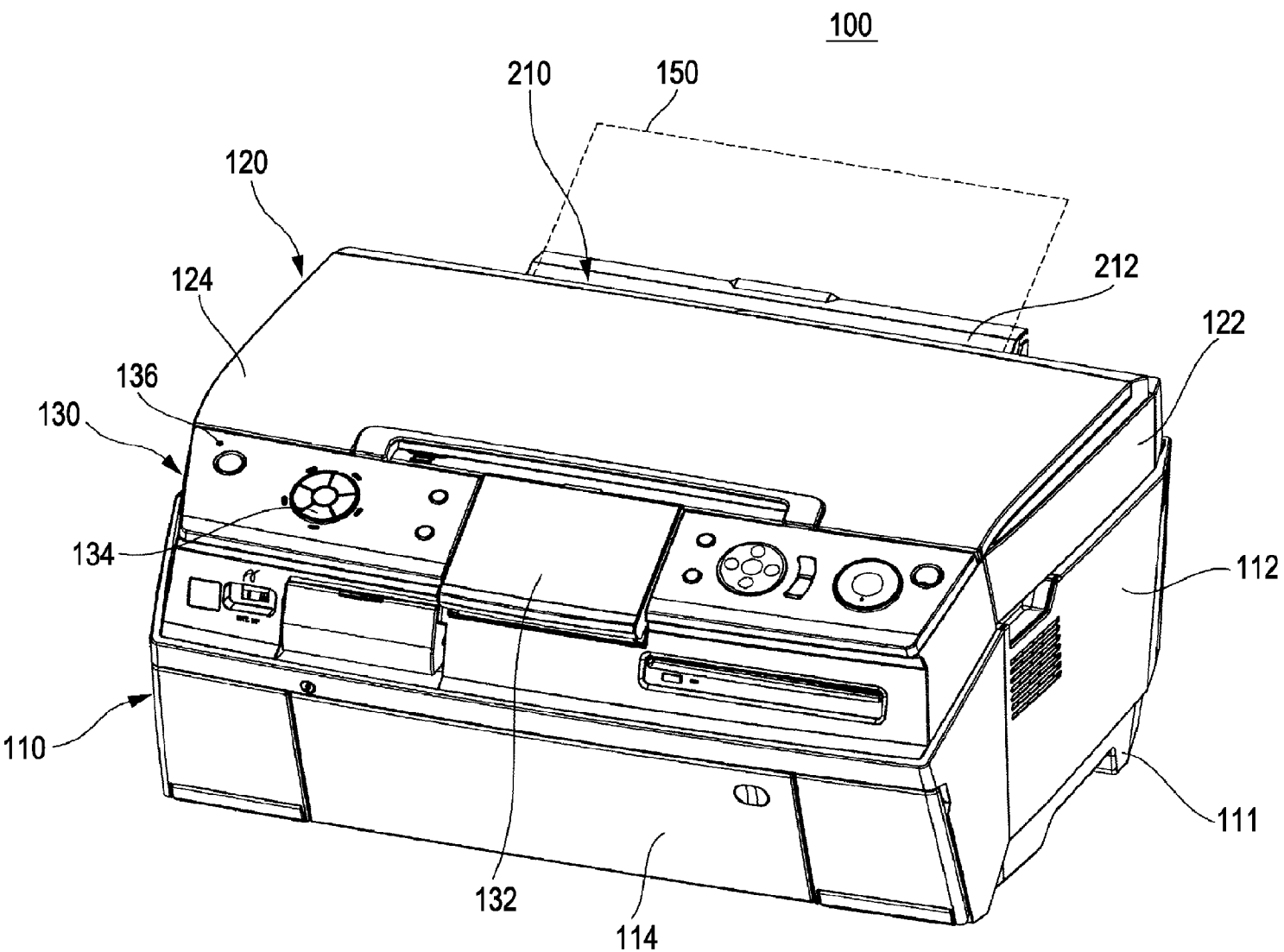
FIG. 1 is a perspective view that schematically shows the entire structure of a multi functional printer.

FIG. 1 is a perspective view that shows an appearance of a multi functional printer 100 provided with an ink jet recording apparatus which is an embodiment of the invention. As shown in the drawing, the multi functional printer 100 includes both a recording unit 110 and a reading unit 120 that is overlapped on top of the recording unit 110.

The reading unit 120 is formed in a case, which also serves as an upper case 122 of the entire multi functional printer 100. On the upper surface of the upper case 122, a reading table is arranged to put an original document that will be read, and an upper cover 124, which also serves as an original copy holder, is further provided to hold an original copy that is put on the reading table.

On the other hand, the recording unit 110 is formed on a case bottom 111 within a case, which also serves as a lower case 112 of the entire multi functional printer 100. In the drawing, a paper support 212 of a feeding unit 210, which will be described later, is shown behind the upper case 122. In addition, on the front face of the lower case 112, a front cover 114 that installs a discharge tray 248 of a discharge unit 240, which will be described later, on the rear face is closed.

Furthermore, the multi functional printer 100 is provided with an operation panel 130 on the front side to the upper cover 124. The operation panel 130 is provided with a plurality of operation buttons 134, a pilot lamp 136, and the like, in addition to a display panel 132. When the multi functional printer 100 is operated in a stand-alone manner, various commands may be input or operating states, and the like, may be displayed.

In the above described multi functional printer 100, the image of an original copy, which is mounted on the reading unit 120 by opening the upper cover 124, will be read from the lower side. In addition, a sheet of recording paper 150 that is set on the paper support 212 is transported through the inside of the recording unit 110 toward the front and an image is recorded on the way by means of an internal mechanism 200, which will be described later.

Figure 2:
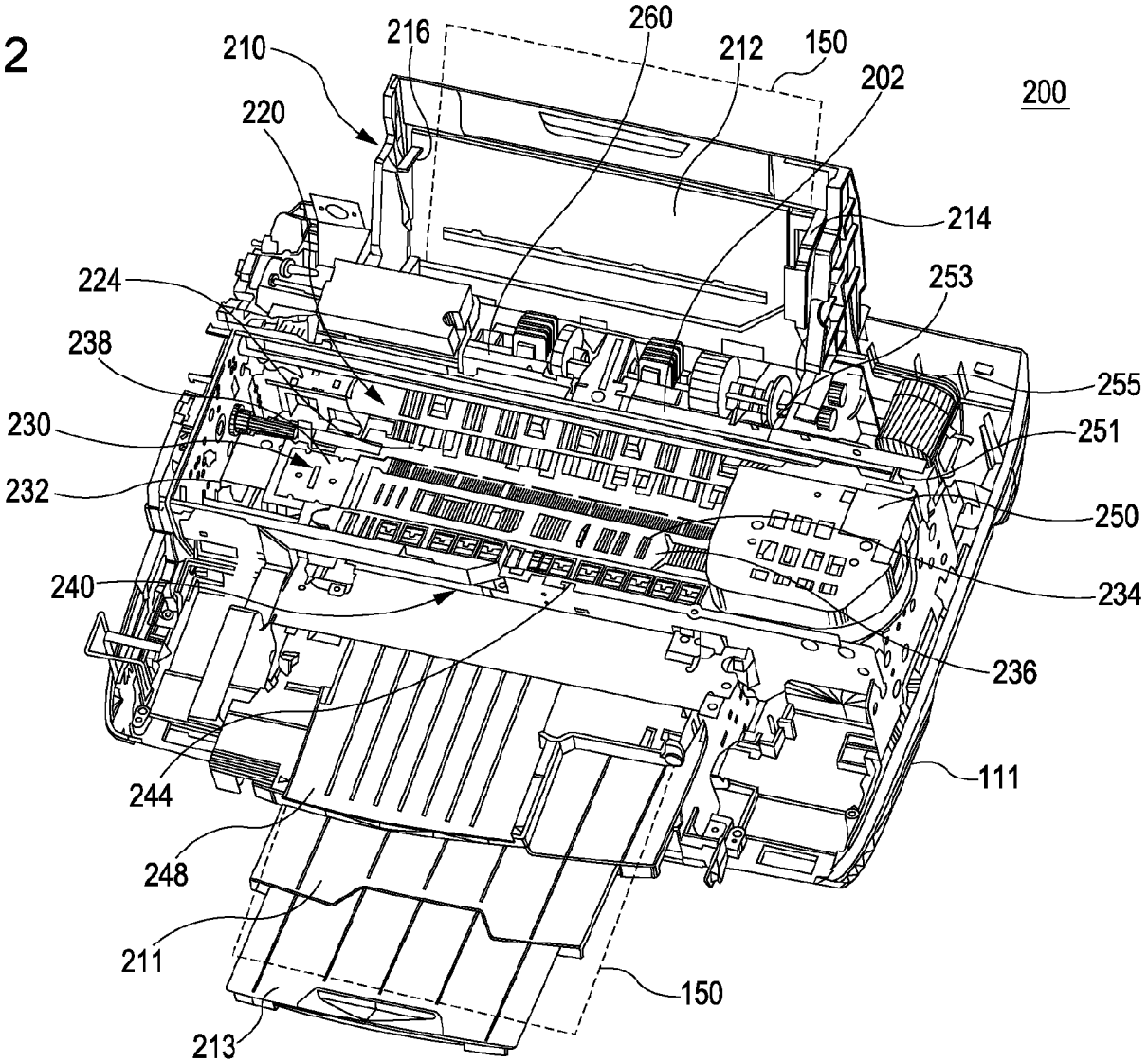
FIG. 2 is a perspective view that specifically shows an internal mechanism of a recording unit.
Figure 3:
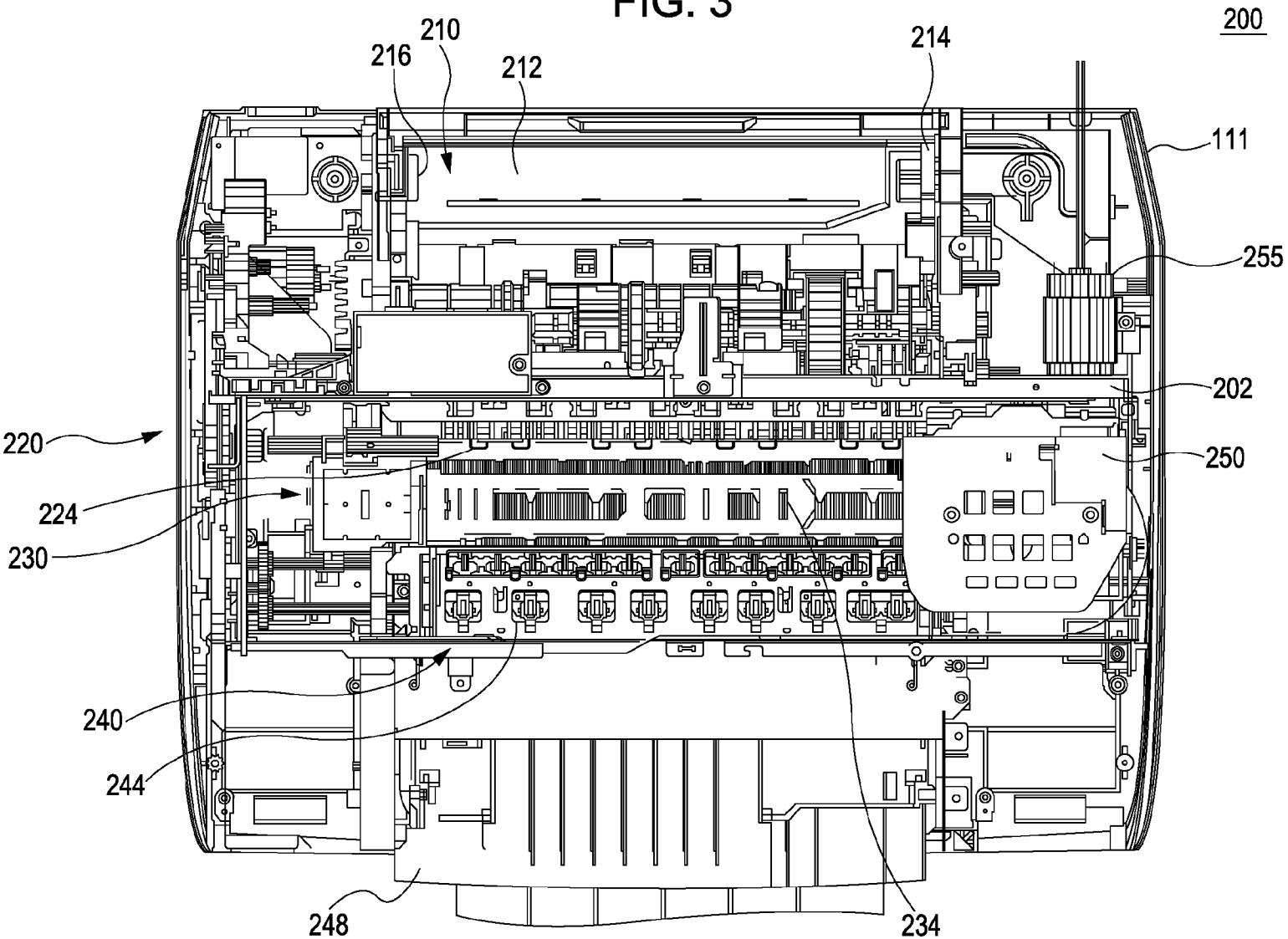
FIG. 3 is a plan view that shows the structure of the internal mechanism as viewed from above.

FIG. 2 is a perspective view that specifically shows the internal mechanism 200 of the recording unit 110 of the multi functional printer 100 shown in FIG. 1. FIG. 3 is a plan view that shows the structure of the internal mechanism 200 as viewed from above. As shown in the drawings, the internal mechanism 200 includes the case bottom 111, a frame 202, the feeding unit 210, a transport unit 220, the platen 230 and the discharge unit 240. The frame 202 extends vertically from the case bottom 111. The feeding unit 210 is arranged behind the frame 202. The transport unit 220, the platen 230 and the discharge unit 240 are serially arranged in front of the frame 202.

The feeding unit 210 includes the paper support 212, a side support 214 and a slide support 216. The paper support 212 supports the rear face of the sheet of recording paper 150 that is set vertically. The side support 214 positions the side end portion of the sheet of recording paper 150, which is shown to the right side of the figures. The slide support 216 prevents the sheet of recording paper 150 from inclining in such a manner that the slide support 216 contacts the side end portion of the sheet of recording paper 150, which is shown to the left side of the figures. The slide support 216 is movable horizontally on the front face of the paper support 212. When the sheet of recording paper 150 having a different width is set, the slide support 216 may be moved to contact the side end portion of the sheet of recording paper 150. The feeding unit 210 further includes a feeding roller 218, and the like, that are hidden by the frame 202. The feeding roller 218, and the like, when the recording unit 110 operates recording, draws a plurality of the sheets of recording paper 150 that are set on the paper support 212 into the internal mechanism 200 sheet by sheet.

Note that the internal mechanism 200 also includes a horizontal paper support 211 that is arranged below the discharge tray 248, which will be described later, and has an opening at the front face. The paper support 211 supports sheets of recording paper 150, which are set horizontally from the front side of the internal mechanism 200, from the lower side. In addition, the sheets of recording paper 150 that are set on the paper support 211 may also be sent to the transport unit 220 using the feeding unit 210. Note that the paper support 211 includes an extension portion 213 and is able to support a sheet of recording paper 150 having a length longer than the depth of the paper support 211 itself.

The transport unit 220 is arranged immediately before the frame 202. The transport unit 220 includes a transporting driven roller 224 that contacts the upper face of the drawn sheet of recording paper 150 and is rotated by the movement of the sheet of recording paper 150. A transporting drive roller is arranged just below the transporting driven roller 224 and is driven by a transporting motor (not shown) for rotation. Thus, the sheet of recording paper 150 that has been drawn into the internal mechanism 200 is pressed against the transporting drive roller by the transporting driven roller 224 and sent onto the platen 230 in accordance with the rotation of the transporting drive roller.

The platen 230 includes a plurality of ribs 234 that extend upward. The ribs 234 contact the lower face of the sheet of recording paper 150 being sent at the distal ends thereof to position the sheet of recording paper 150 in a vertical direction. The sheet of recording paper 150 that has passed the upper side of the platen 230 finally arrives at the discharge unit 240. Note that the structure of the platen 230 will be specifically described separately with reference to FIG. 4.

The discharge unit 240 is arranged to the front side of the platen 230. The discharge unit 240 includes a discharge driven roller 244 that contacts the upper face of the sheet of recording paper 150, which has been sent through the upper side of the platen 230, and is rotated in accordance with the movement of the sheet of recording paper 150. A discharge drive roller is arranged just below the discharge driven roller 244 and is driven by the transporting motor for rotation through a rotation transmitting mechanism (not shown). The sheet of recording paper 150 is pressed against the transporting drive roller by the discharge driven roller 244 and is sent to the front side of the recording unit 110 in accordance with the rotation of the discharge drive roller. The discharge tray 248 is arranged to the front side of the discharge unit 240. The sheets of recording paper 150 that have been discharged outside the recording unit 110 will be stacked on the discharge tray 248.

Furthermore, the internal mechanism 200 includes a carriage 250 that reciprocally moves above the platen 230. That is, the carriage 250 is mounted so that it is movable horizontally in the longitudinal direction of the frame 202 along a guide member (not shown) that is provided on the front face of the frame 202 and extends in the longitudinal direction of the frame 202. In addition, a timing belt 253 is arranged to the front face of the frame 202 and is wound around a pair of pulleys 251. Furthermore, the carriage 250 is connected to the timing belt 253 at the rear face thereof.

In the meantime, because one of the pulleys 251 is driven by the carriage motor 255 for rotation, the carriage 250 moves in accordance with the displacement of the timing belt 253. Thus, by controlling the operation and rotating direction of the carriage motor 255, it is possible to move the carriage 250 to the upper side of an arbitrary region on the platen 230. Furthermore, the carriage 250 includes a recording head (not shown), which includes a nozzle plate 252, at the lower face thereof. Thus, the carriage 250 is able to discharge ink toward an arbitrary region on the platen 230.

In the multi functional printer 100 provided with the internal mechanism 200 having the above described structure, the sheets of recording paper 150 that are set on the front paper support 211 or the rear paper support 212 are drawn by the feeding unit 210 into the transport unit 220 sheet by sheet. The sheet of recording paper 150 that has been drawn to the transport unit 220 passes the upper side of the platen 230 and then reaches the discharge unit 240. The sheet of recording paper 150 is finally sent by the discharge unit 240 outside the internal mechanism 200.

In addition, when the sheet of recording paper 150 is present above the platen 230, the carriage 250 discharges ink downward while reciprocally moving above the platen 230. Thus, it is possible to discharge ink and adhere the ink to an arbitrary region on the front face of the sheet of recording paper 150. Further, the sheet of recording paper 150 is transported intermittently line by line, while the carriage 250 is reciprocally moved during the transportation is interrupted. Thus, an image may be recorded over the entire surface of the sheet of recording paper 150.

Note that a control unit 260 is mounted behind the frame 202 and controls a series of recording operations as described above. The control unit 260 controls the recording unit 110 to operate appropriately on the basis of commands input through an information processing device, or the like, which is connected to the multi functional printer 100, or commands input through the operation panel 130. In addition, the control unit 260 is also an interface that receives image information that will be recorded by the recording unit 110. The image information received by the control unit 260 may include, in addition to the information that indicates resolution of a recording image, a recording quality such as the number of colors, recording object information such as size and material.

Figure 4:
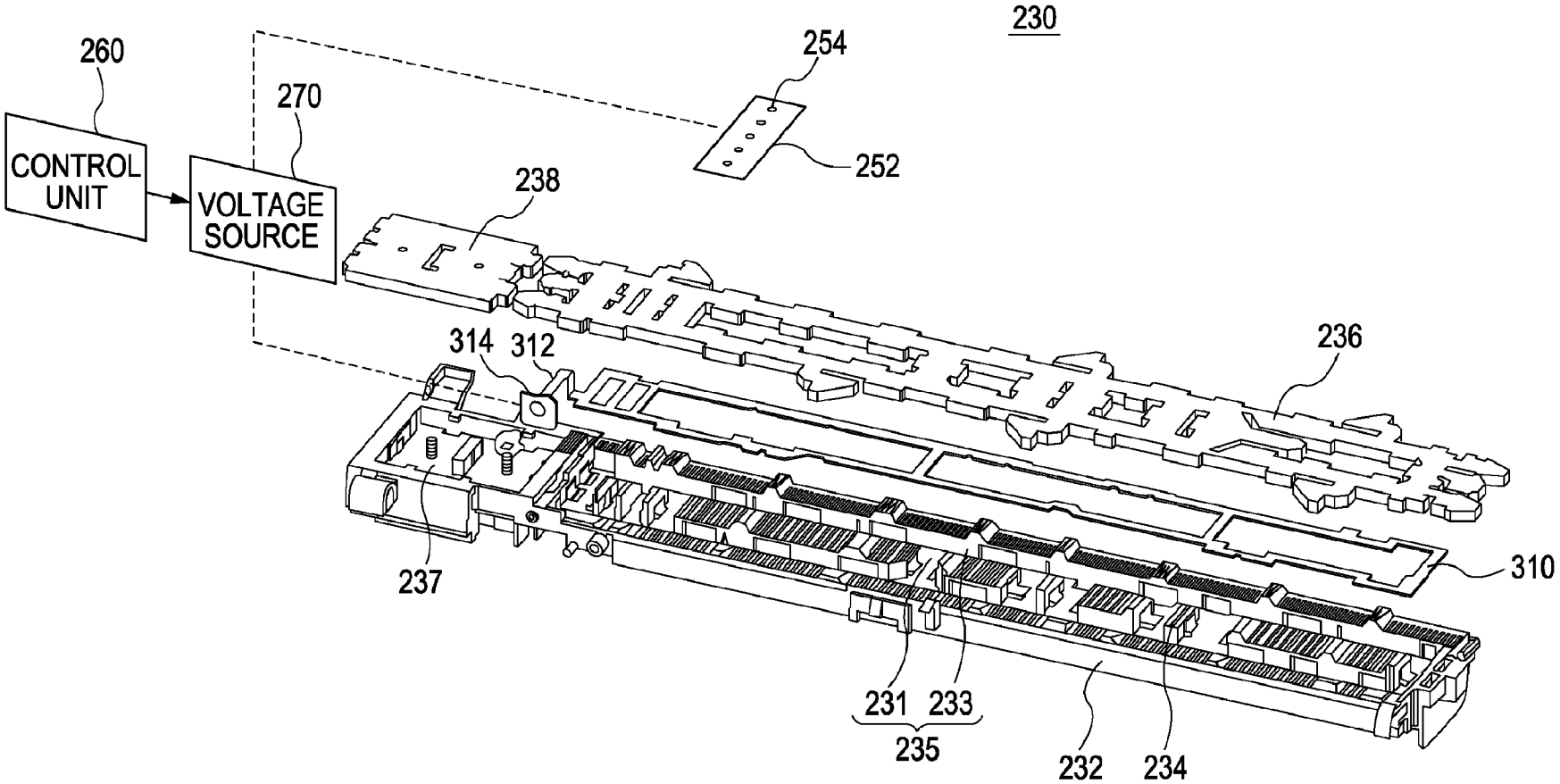
FIG. 4 is an exploded perspective view that shows the structure of a platen alone.

FIG. 4 is an exploded perspective view that specifically shows the structure of the platen 230 in the internal mechanism 200. As shown in the drawing, the platen 230 includes a platen body 232, an electrode 310 and absorption members 236, 238. The electrode 310 is accommodated in the platen body 232.

The platen body 232 is integrally formed from a resin material to include the plurality of ribs 234, an accommodation portion 235 and an accommodation portion 237. The plurality of ribs 234 extend upward from the upper face of the platen body 232. The accommodation portion 235 having a larger width is depressed from the upper face of the platen body 232 and formed to include a bottom portion 231 and a side wall portion 233. The accommodation portion 237 having a smaller width is formed to the side of a region in which the ribs 234 are formed. When the sheet of recording paper 150 passes above the platen 230, the upper ends of the ribs 234 contact the lower face (rear face) of the sheet of recording paper 150 to position the sheet of recording paper 150 in the vertical direction.

In addition, the absorption members 236, 238 have a size to fill the inside of the platen bodies 232, 237. Further, the absorption members 236, 238 are formed of a material that is selected by laying emphasis on absorption velocity of the surfaces thereof with respect to liquid. For this reason, the amount of ink that the absorption members 236, 238 can hold is limited. Then, a waste liquid absorption member, which has a larger capacity than these absorption members 236, 238, may be additionally arranged below the platen 230.

The platen 230 further includes the electrode 310 below the absorption member 236 inside the wider accommodation portion 235. The electrode 310 is arranged to substantially cover the bottom portion 231 of the accommodation portion 235. Further, a connecting portion 312 and a terminal portion 314 are integrally formed at one end of the electrode 310. The connecting portion 312 extends outward over the side wall portion 233 of the accommodation portion 235. The terminal portion 314 is exposed to the outside of the platen 230. When the electrode 310 is connected through the terminal portion 314 to one end of a voltage source 270, which operates under the control of the control unit 260, it is possible to apply voltage to the electrode 310. The other end of the voltage source 270 is connected to the nozzle plate 252, which is mounted on the carriage 250. Thus, it is possible to generate a difference in potential between the nozzle plate 252 and the electrode 310 to form an electric field.

The material of the absorption members 236, 238 may preferably include a material that is made by foaming a resin material, such as polystylene or polyurethane. In addition, for the purpose of applying the same potential to the absorption member 236 as that of the electrode 310, it is preferable that the absorption member 236 is formed of a conductive material that will have a surface resistance of $10^8\Omega$ or below. Such a material may be a material that is formed by foaming a resin, such as polyethylene or polyurethane, that has been mixed with a conductive material, such as metal or carbon or a material in which a conductive material, such as metal or carbon, is adhered or plated onto a foamed resin made from a material, such as polyethylene or polyurethane. In addition, it may also be used as the material that electrolytic solution is impregnated into a foamed resin made from a material, such as polyethylene or polyurethane.

On the other hand, the material of the electrode 310 may include a metal that is anticorrosive to ink, such as a wire, a plate or a foil that is made of gold, stainless, or nickel; a wire, a plate or a foil that is plated with these metals; or a mesh or a grid like member that combines some of these materials. Moreover, according to another embodiment, a conductive coating film layer, a plating layer, a thick film layer, a thin film layer, or the like, which is directly formed on the bottom portion 231 of the accommodation portion 235 of the platen 230, may also be used as the electrode 310.

Figure 5:
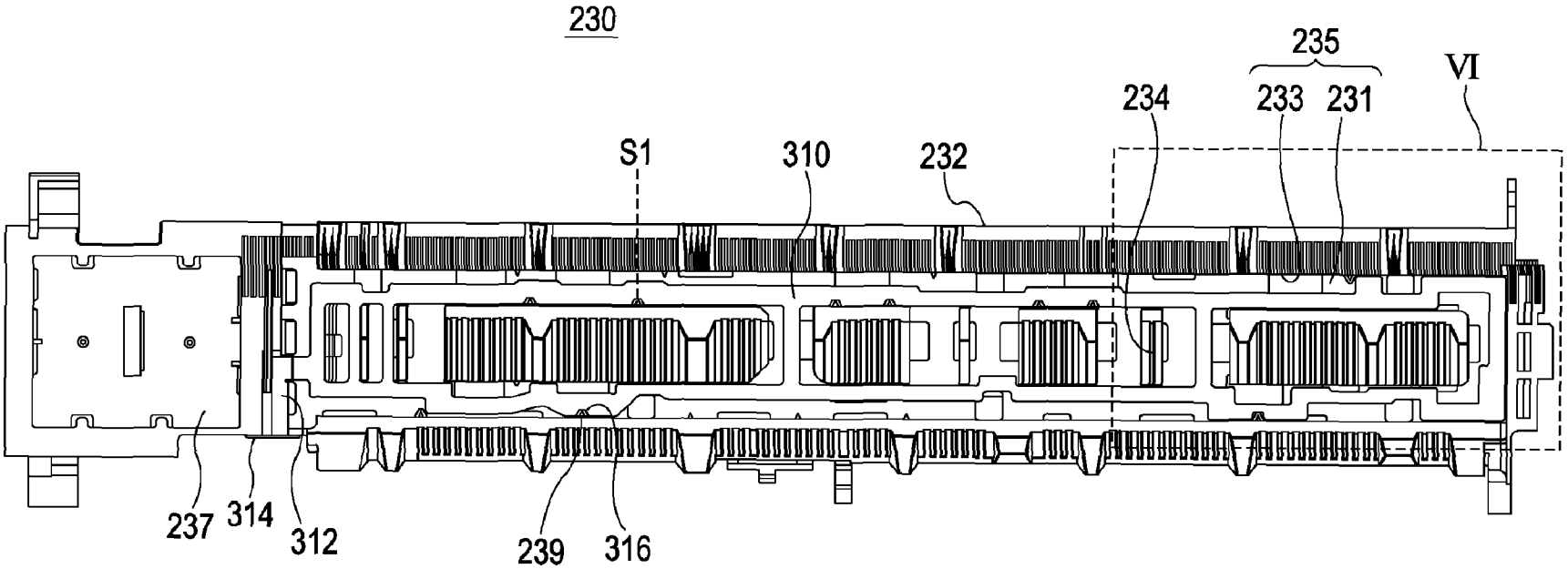
FIG. 5 is a plan view that shows a process of assembling an electrode to a platen body.

FIG. 5 is one of figures that show the attaching structure of the electrode 310 in the platen 230 using the procedure of attaching the electrode 310. As shown in the drawing, the electrode 310 that is shown to the upper side of the platen body 232 in FIG. 4 is accommodated in the bottom portion 231 of the accommodation portion 235 that is formed in the platen 230. In addition, the electrode 310 has a plate-like shape that follows the shape of the bottom portion 231.

However, the electrode 310 is not fixed in a state shown in FIG. 5. That is, a plurality of engaging pawls 239 are formed on the side wall portion 233 of the accommodation portion 235 so as to extend inward of the accommodation portion 235. On the other hand, cutout portions 316 are formed at the periphery of the electrode 310 and located at positions corresponding to the engaging pawls 239.

Figure 6:
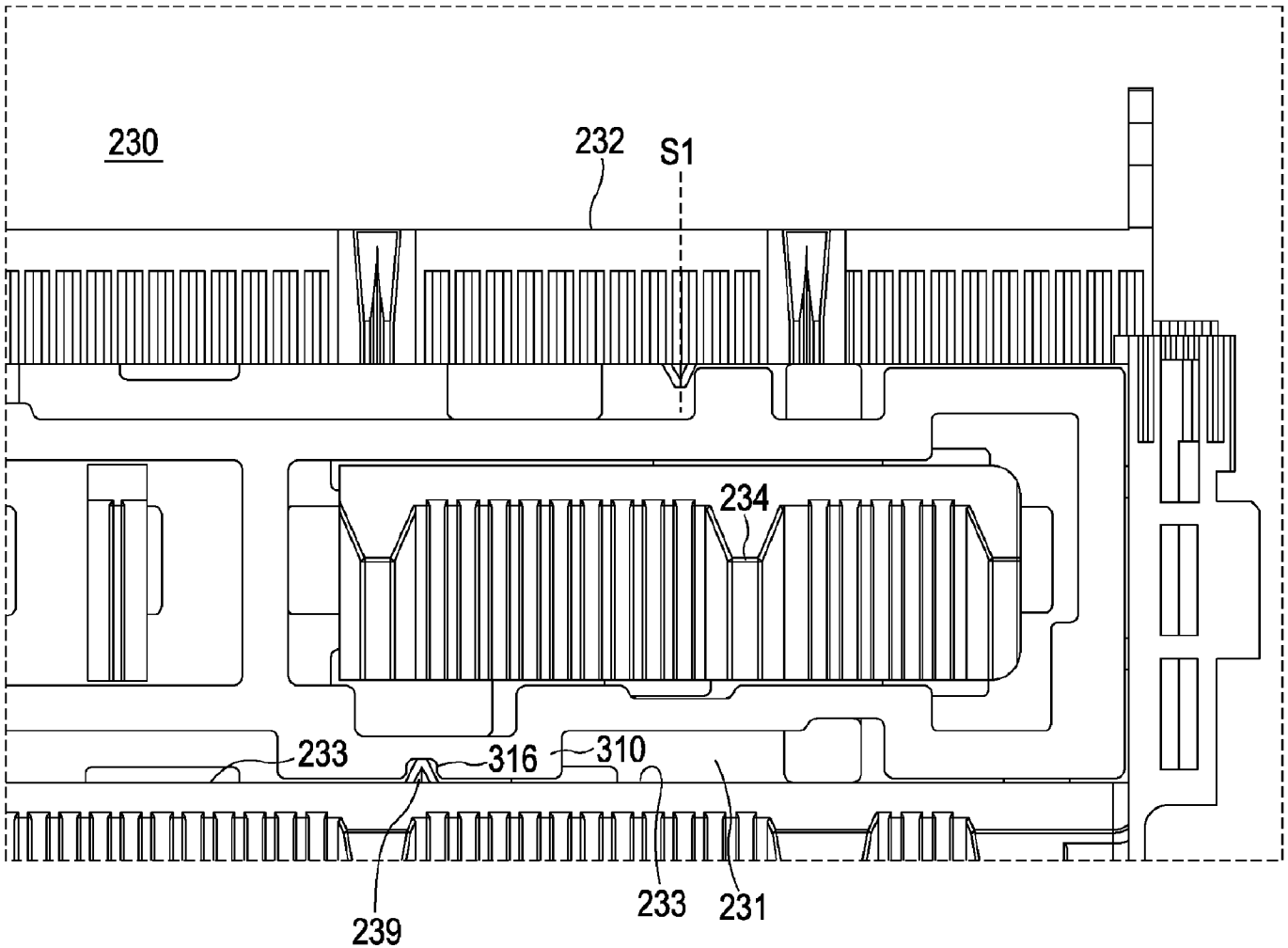
FIG. 6 is a partially enlarged view of the platen body shown in FIG. 5.

FIG. 6 is a partially enlarged view that shows a state just after the engaging pawl 239 is passed through the cutout portion 316. FIG. 6 corresponds to a portion surrounded by dotted line VI shown in FIG. 5. As shown in the drawing, the planar shape of the cutout portion 316 is larger in area than the planar shape of the engaging pawl 239. Thus, by passing the engaging pawl 239 through the cutout portion 316, it is possible to easily insert the electrode 310 into the accommodation portion 235 to such an extent that the electrode 310 contacts the bottom portion 231.

Figure 7:
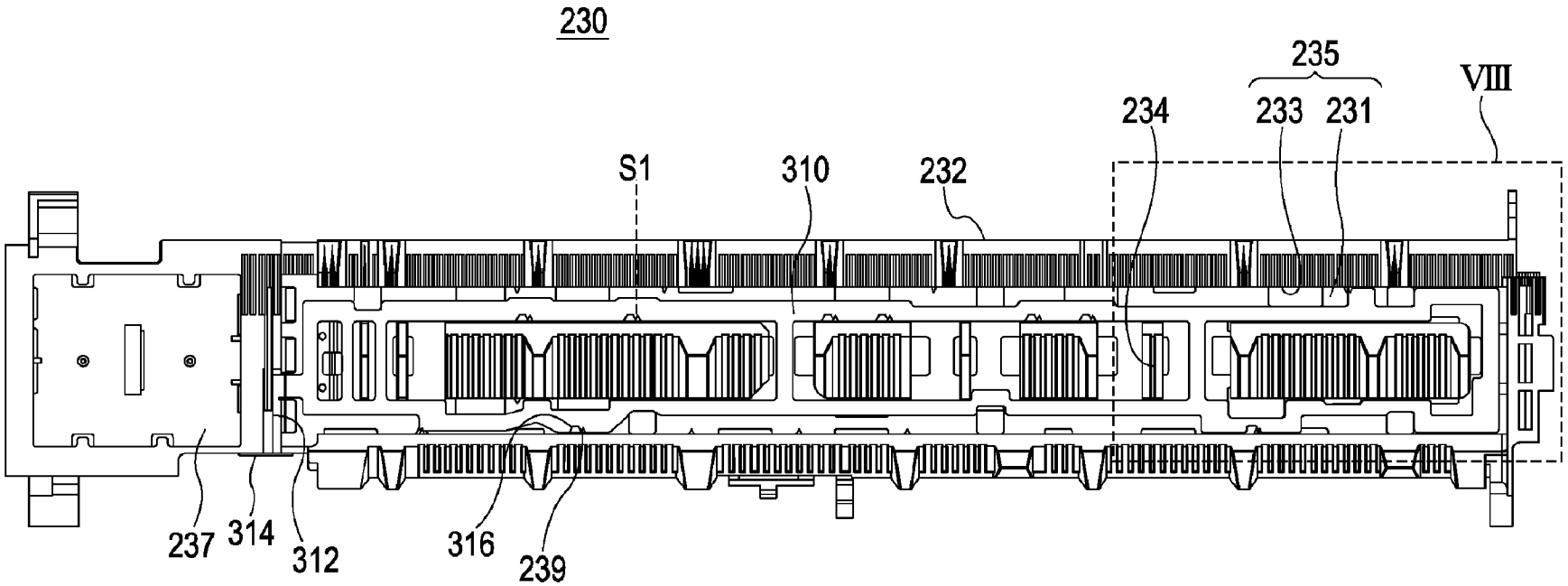
FIG. 7 is a plan view that shows the next process of assembling the electrode to the platen body.

FIG. 7 is a plan view that shows the next process of assembling the electrode 310 to the platen body 232. As shown in the drawing, in comparison with the state shown in FIG. 5, the electrode 310 is displaced to the left side in the drawing.

Figure 8:
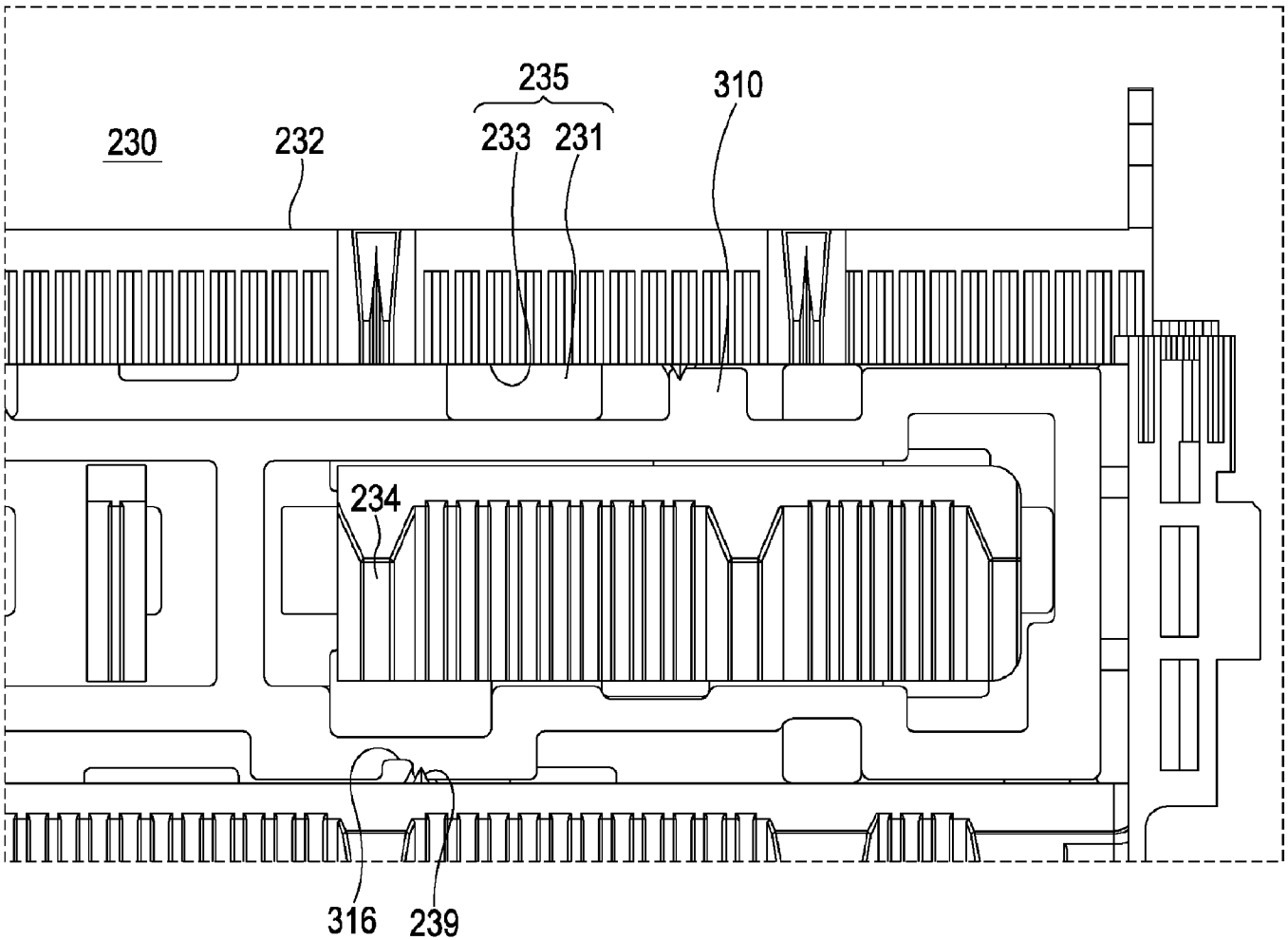
FIG. 8 is a partially enlarged view of the platen body shown in FIG. 7.

FIG. 8 is a partially enlarged view of the platen body 232 shown in FIG. 7. FIG. 8 shows a region surrounded by dotted line VIII in FIG. 7. As shown in the drawing, because the cutout portion 316 is displaced in accordance with the movement of the electrode 310, the engaging pawl 239 adjacent to the platen body 232 is displaced to the outside of the cutout portion 316.

Figure 9:
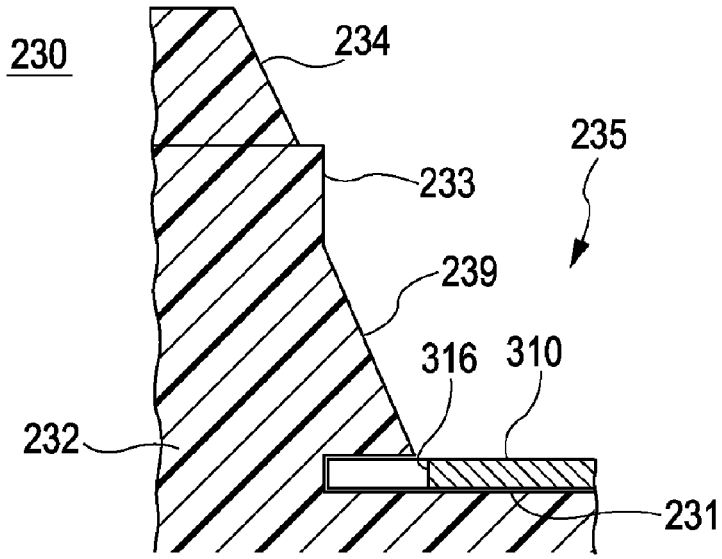
FIG. 9 is a cross-sectional view that shows the positional relationship between an engaging pawl and a cutout portion in a state shown in FIG. 5.

FIG. 9 is a cross-sectional view, taken along the dotted line S1 in FIG. 5, that shows the positional relationship between the engaging pawl 239 and the cutout portion 316 in a state shown in FIG. 5. As shown in the drawing, immediately after the electrode 310 has been set into the accommodation portion 235, the electrode 310 is not located just below the engaging pawl 239.

Figure 10:
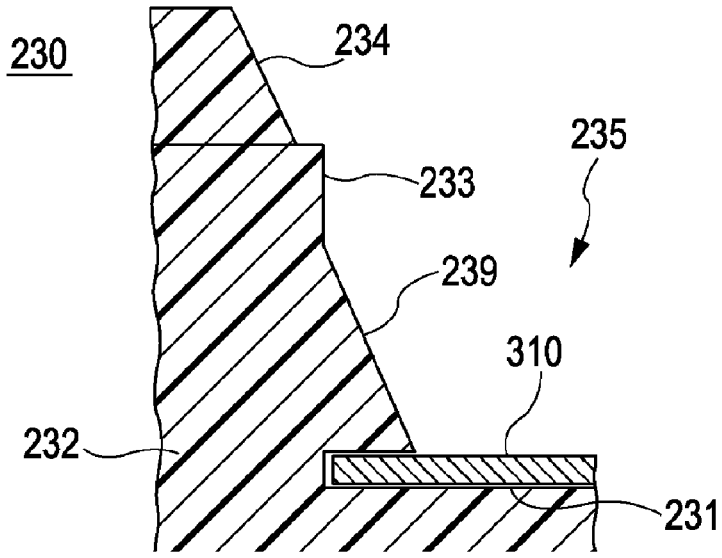
FIG. 10 is a cross-sectional view that shows the positional relationship between an engaging pawl and a cutout portion in a state shown in FIG. 7.

FIG. 10 is a cross-sectional view, taken along the dotted line S1 in FIG. 7, that shows the positional relationship between the engaging pawl 239 and the cutout portion 316 in a state shown in FIG. 7. As shown in the drawing, when the electrode 310 is displaced horizontally from the state shown in FIG. 9, the cutout portion 316 moves to a position that is offset from the position just below the engaging pawl 239. Thus, portion of the upper face of the electrode 310 enters below the engaging pawl 239. For this reason, even when electrostatic force acts on the electrode 310 by applying voltage, upward movement of the electrode 310 is stopped by the engaging pawl 239.

Figure 11:
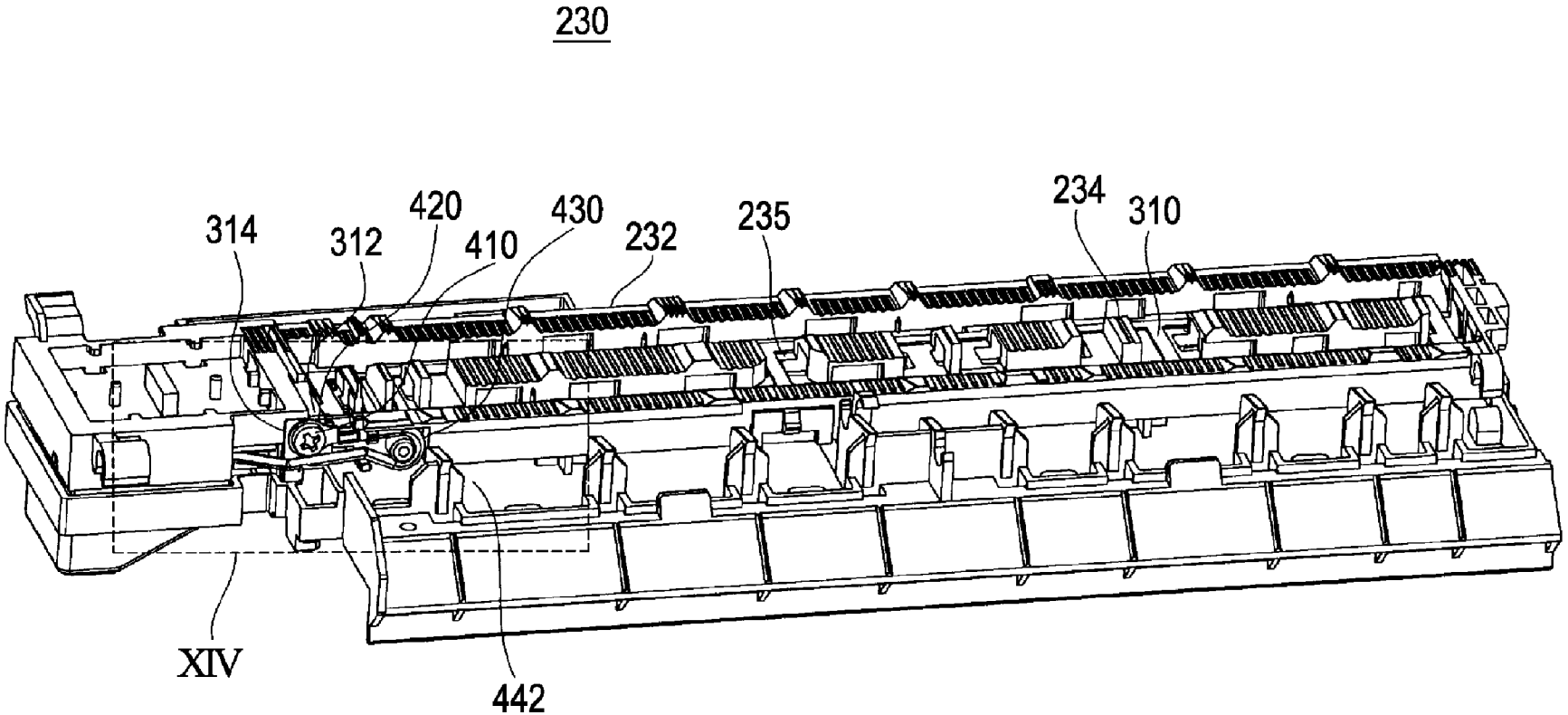
FIG. 11 is a perspective view that shows the fixing structure of the mounted electrode and the structure of electrical connection to the electrode.

FIG. 11 is a perspective view that shows the fixing structure of the mounted electrode 310 and the structure of electrical connection to the electrode 310. As shown in the drawing, portion of the electrode 310 is connected through the connecting portion 312, which extends from the end portion of the electrode 310, to the terminal portion 314 that is positioned on the outer surface of the platen body 232. Thus, by fastening the terminal portion 314 to the platen body 232 through a screw 410, it is possible to suppress the entire electrode 310 from falling off.

That is, as described above, the electrode 310 that has been set in the accommodation portion 235 of the platen body 232, once after it is set into the accommodation portion 235, is displaced horizontally along the bottom portion 231. In this manner, the electrode 310, which partially enters the lower side of the engaging pawl 239, is restricted so that the electrode 310 is restricted from moving in a direction away from the bottom portion 231. Further, by restricting the horizontal displacement of the electrode 310 by means of the screw 410, the cutout portion 316 is never positioned just below the engaging pawl 239 again, and the electrode 310 is permanently fixed to the platen body 232.

The screw 410, which fixes the terminal portion 314 of the electrode 310 to the platen body 232, holds a crimp terminal 420 between the terminal portion 314 and the screw 410 to fix the terminal portion 410. The crimp terminal 420 is attached to one end of the connection cable 430. The other end of the connection cable 430 is connected to the voltage source 270, which is not shown in FIG. 11.

Furthermore, as shown in the drawing, an additional accommodation member 442 is attached to the front face of the platen body 232 and receives ink that overflows from the accommodation portion 235 of the platen 230, which will be described later. The additional accommodation member 442 has such a width that extends from a position adjacent to the right side of the screw 410, which fixes the terminal portion 314 of the electrode 310, to the right end of the platen body 232.

Figure 12:
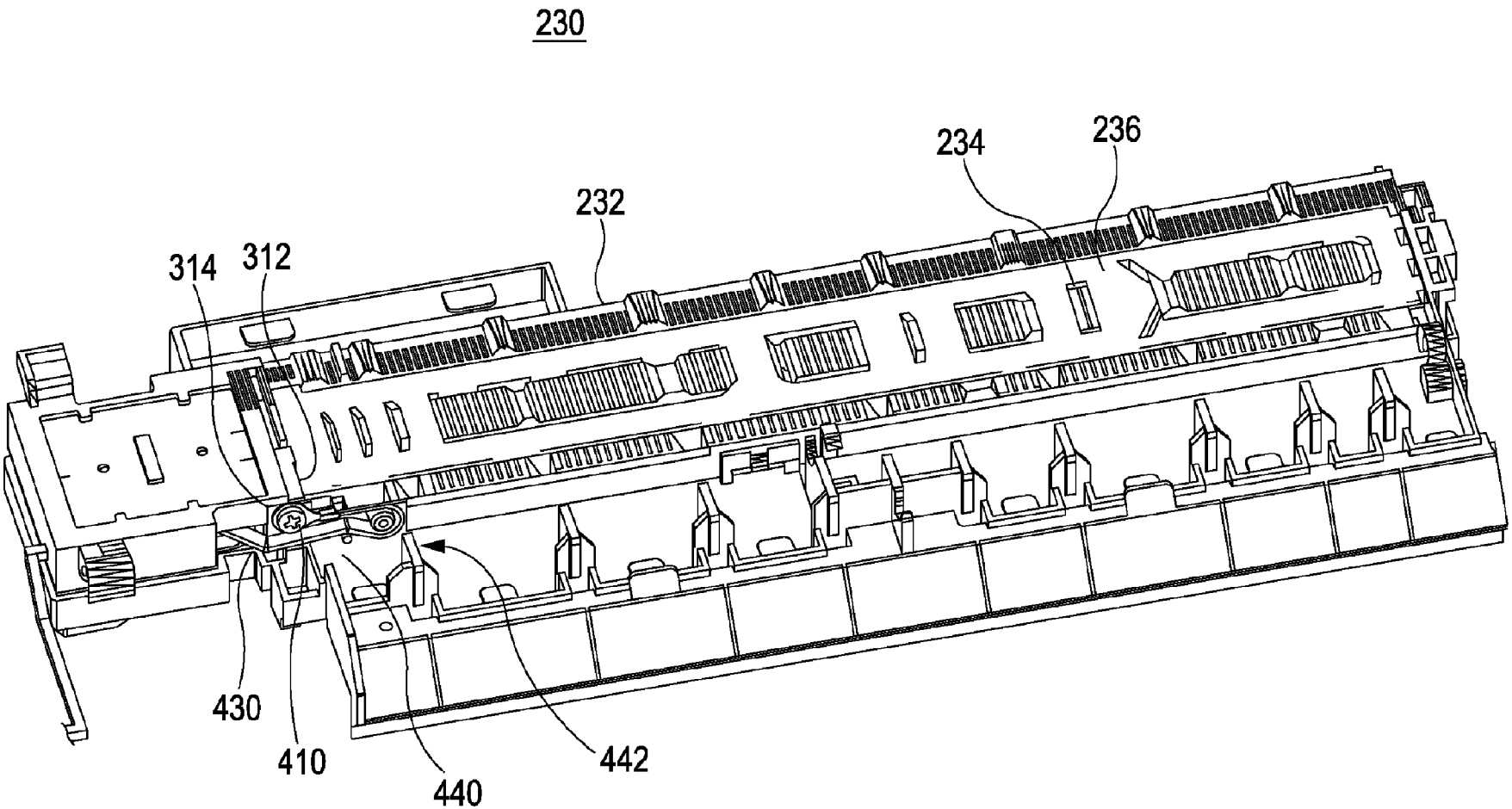
FIG. 12 is a perspective view that shows a state where an absorption member is further mounted on the platen body on which the electrode is mounted as shown in FIG. 11.

FIG. 12 is a perspective view that shows a state where the absorption member 236 is further mounted on the platen body 232 on which the electrode 310 is mounted as shown in FIG. 11. As shown in the drawing, the absorption member 236 is arranged around the ribs 234 that are integrally formed with the platen body 232. The absorption member 236 is able to absorb ink that is discharged from the nozzle plate 252 but not adhered to a sheet of recording paper 150. In addition, an additional absorption member 440 is accommodated inside the additional accommodation member 442. Note that the additional absorption member 440, as well as the absorption member 236, is formed of a porous material that easily absorbs liquid. Specifically, the material may be preferably a material that is formed by foaming a resin material, such as polyethylene or polyurethane, but the material is not limited to it.

As shown in the drawing, the electrode 310 is hidden below the absorption member 236. However, at the left end of the accommodation portion 235 in the drawing, the electrode 310 is elongated through the connecting portion 312 to the upper face of the absorption member 236 and to the front and outside of the accommodation portion 235 and then connected to the terminal portion 314. Note that the additional absorption member 440 is also electrically insulated from other components located outside the platen 230, while it may be electrically connected to the accommodation portion 235 due to absorbed ink.

Figure 13:
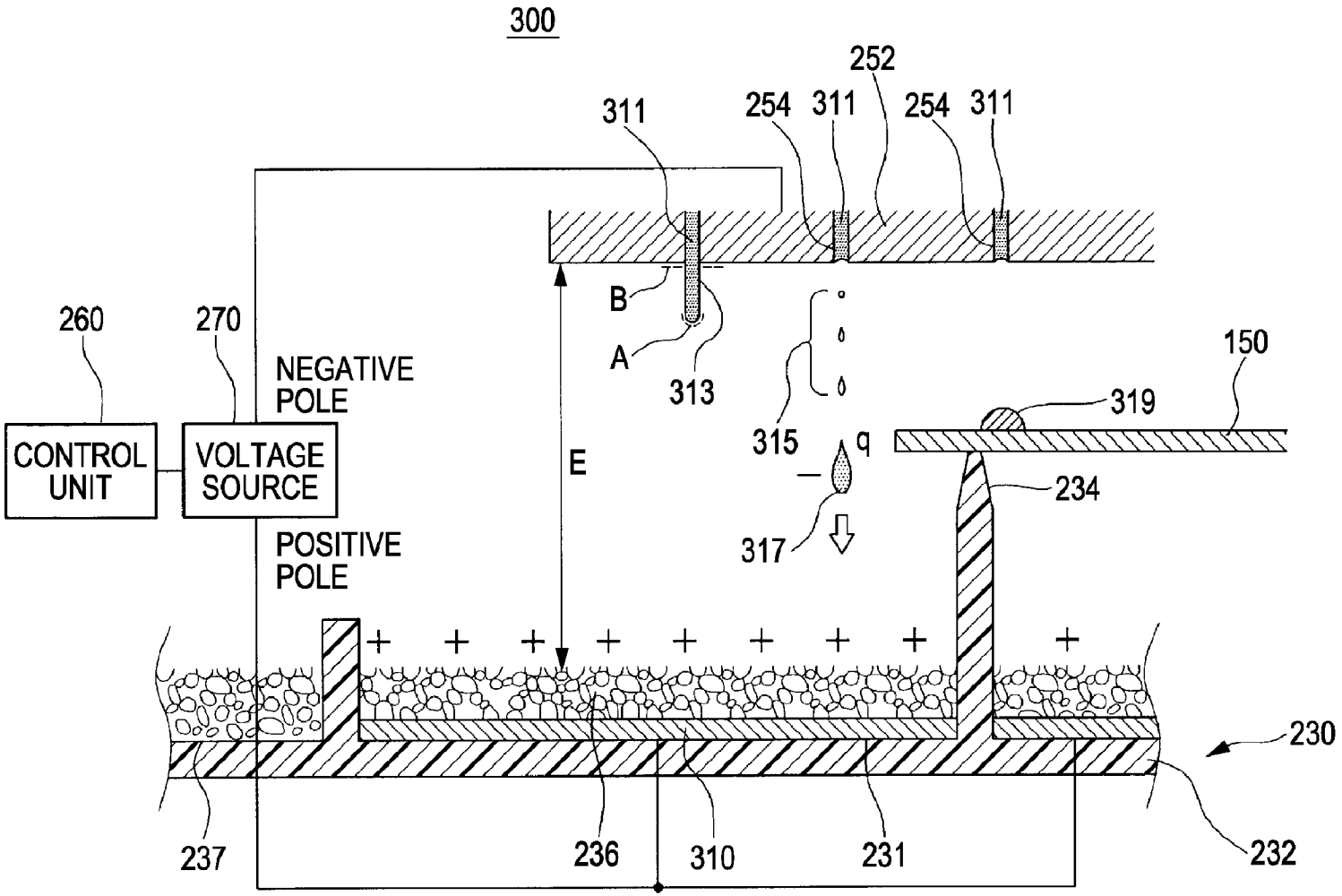
FIG. 13 is a conceptional view that illustrates operation of an aerosol collecting mechanism.

FIG. 13 is a schematic view that illustrates the structure and operation of an aerosol collecting mechanism 300 formed in the internal mechanism 200 of the recording unit 100. As shown in the drawing, the nozzle plate 252 that has openings 254 for discharging ink is, for example, made of metal and has a conductivity. Moreover, the nozzle plate 252 is connected to the negative electrode of the voltage source 270. On the other hand, the positive electrode of the voltage source 270 is connected to the electrode 310 that is accommodated in the platen 230. Further, the absorption member 236, which is stacked on the electrode 310 and accommodated in the platen 230, has a conductivity, so that the entire absorption member 236 is applied with the same potential as that of the electrode 310. Thus, an electric field E caused by a difference in potential generated by the voltage source 270 is uniformly formed between the lower face of the nozzle plate 252 and the surface of the absorption member 236. Note that, even when all the polarities may be inverted and connected, the same function may be achieved.

During the operation of recording, the nozzle plate 252 discharges inks 311 through the openings 254 downward. Here, when the sheet of recording paper 150 is present just below the openings 254, the discharged inks 311 are adhered onto the upper face of the sheet of recording paper 150 to form an image 319. On the other hand, when the inks 311 are intended to be adhered to the peripheral portion of the sheet of recording paper 150 without any remaining margin, there is a possibility that the sheet of recording paper 150 is not present just below portions of the openings 254 around the side periphery, front periphery and rear periphery of the sheet of recording paper 150.

In this case, kinetic energy given to ink droplets 317 that are generated through the discharge from the openings 254 is rapidly lost due to the viscous drag of the atmosphere. For this reason, portions of the ink droplets 317 lose their kinetic energy far before they reach the conductive absorption member 236. Since the weight of each ink droplet 317 is extremely small, when the ink droplet 317 loses its kinetic energy, the following falling velocity becomes extremely small because falling motion due to gravitational acceleration becomes substantially equal to a viscous drag force of the atmosphere. In this way, aerosols that float below the nozzle plate 252 are produced. In addition, part of the ink droplets 317 may be split to become further fine ink droplets, that is, satellite inks 315, this also becomes aerosols.

However, in the aerosol collecting mechanism 300, as is already described above, the electric field E is formed between the surface of the absorption member 236 and the lower face of the nozzle plate 252. Thus, the ink droplet 317 having an electric charge q gains kinetic energy owing to Coulomb force Fe (qE) that is received from the electric field E and moves downward without any deceleration to reach the absorption member 236.

Note that the inks 311 that are pushed out from the openings 254 each form an ink column 313 that hangs down from the nozzle plate 252 at the moment immediately before each ink 311 leaves from the nozzle plate 252 to become the ink droplet 317. At this time, an electric charge is stored between a distal end A of the ink column 313 and a region B around the ink column 313 on the lower face of the nozzle plate 252 due to a so-called lightning rod effect. Due to this lightning rod effect, each of the ink droplets 317 is charged with an electric charge q that is larger than an electric charge corresponding to a horizontal cross-sectional area of the ink column 313. Note that the lightning rod effect means a phenomenon that the region B on the surface of the nozzle plate 252, surrounded by a conical shape which has a vertex positioned at the distal end A (lower end in the drawing) of the ink column 313 and a vertical angle of 50 degrees to 60 degrees, contributes to charging of the ink droplet 317. Thus, each of the ink droplets 317 receives a relatively large Coulomb force and flies in the electric field E to the absorption member 236.

Figure 14:
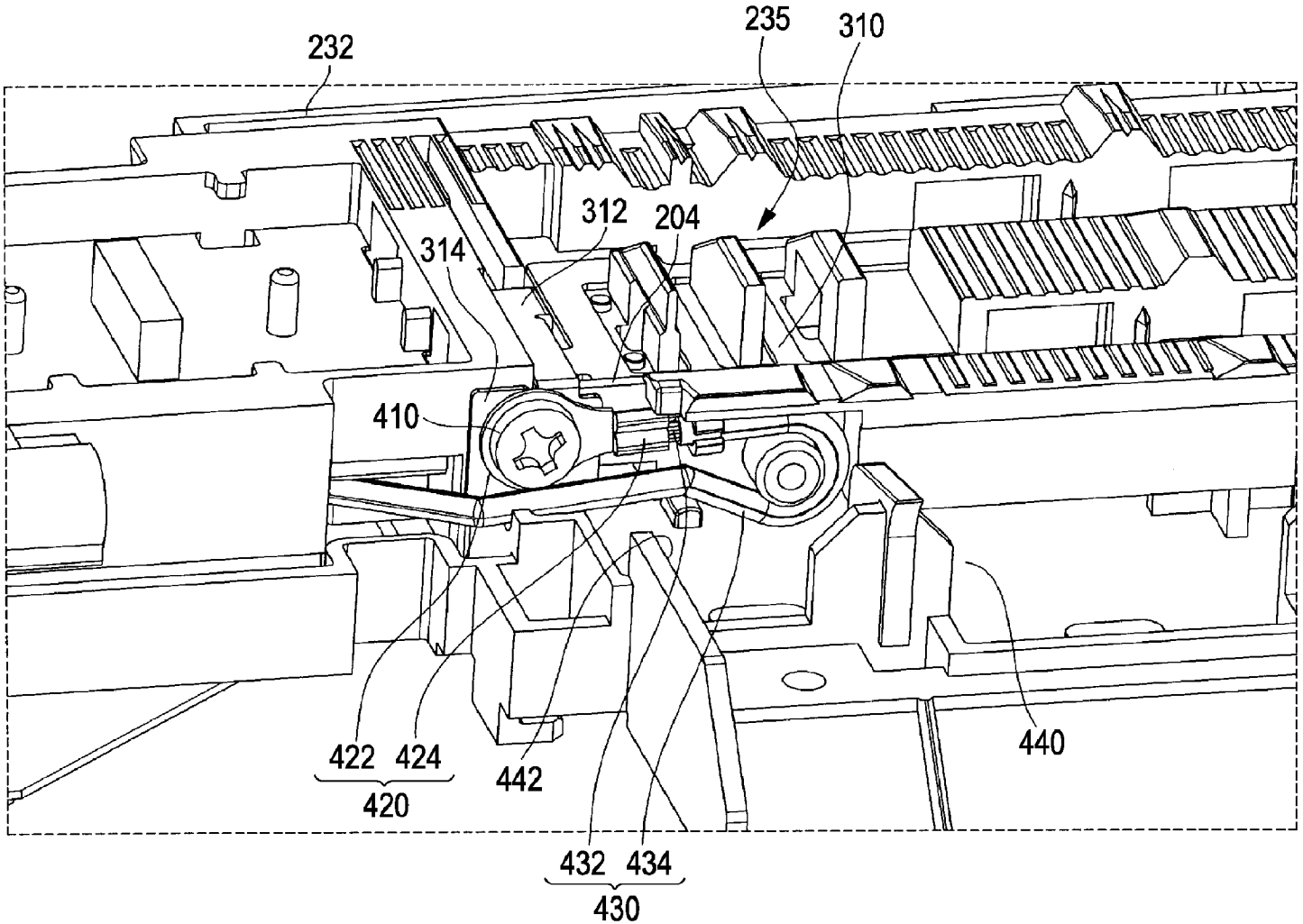
FIG. 14 is an enlarged view that shows a relevant part of the fixing structure and connection structure shown in FIG. 11 and FIG. 12.

FIG. 14 is an enlarged view that shows a relevant part of the fixing structure and connection structure shown in FIG. 11 and FIG. 12. As shown in the drawing, the connection cable 430 is formed so that a conductive core wire 432 is covered with an insulating coating 434. At the end portion of the connection cable 430, the insulating coating 434 is removed and the conductive core wire 432 is exposed. On the other hand, the crimp terminal 420 includes an annular portion 422 and a crimp sleeve portion 424. The annular portion 422 has the screw 410 passed therethrough. The crimp sleeve portion 424 has the conductive core wire 432 of the connection cable 430 passed therethrough. Thus, the conductive core wire 432, which is exposed at the end portion of the connection cable 430, is inserted through the crimp sleeve portion 424, the crimp sleeve portion 424 is then caulked to reduce its diameter. Thus, the conductive core wire 432 is held and, in addition, electrical connection is ensured.

Here, as described above, when the electrode 310 is attached, the electrode 310 is once set into the accommodation portion 235 and then horizontally moved. In this case, the connecting portion 312 and the terminal portion 314, which are arranged along the side wall portion 233 of the accommodation portion 235, also move horizontally at the same time. Therefore, a cutout portion 204 that has the connecting portion 312 passed therethrough on the upper end face of the side wall portion 233 has a width larger than that of the connecting portion 312. Thus, after the electrode 310 is fixed by means of the screw 410, the cutout portion 204 is partially exposed to the right side of the connecting portion 312 in the drawing.

This exposed cutout portion 204 is the lowest portion of the side wall portion 233 that surrounds the accommodation portion 235 of the platen 230. Thus, when the ink stored in the accommodation portion 235 has increased, the ink first flows out through the cutout portion 204. However, as described above, the additional accommodation member 442 extends to the right side of the screw 410, that is, to the region just below the exposed portion of the cutout portion 204, so that ink that has flown out flows into the additional accommodation member 442. Furthermore, ink that has flown down through the inside of the additional accommodation member 442 is finally absorbed and held by the additional absorption member 440. Thus, the outflow ink does not adhere to other portions inside the recording unit 110. Note that, in light of the above function, the cutout portion 204, which is released after the connecting portion 312 of the electrode 310 is moved and fixed, is desirably formed at a position adjacent to the middle of the additional accommodation member 442.

Figure 15:
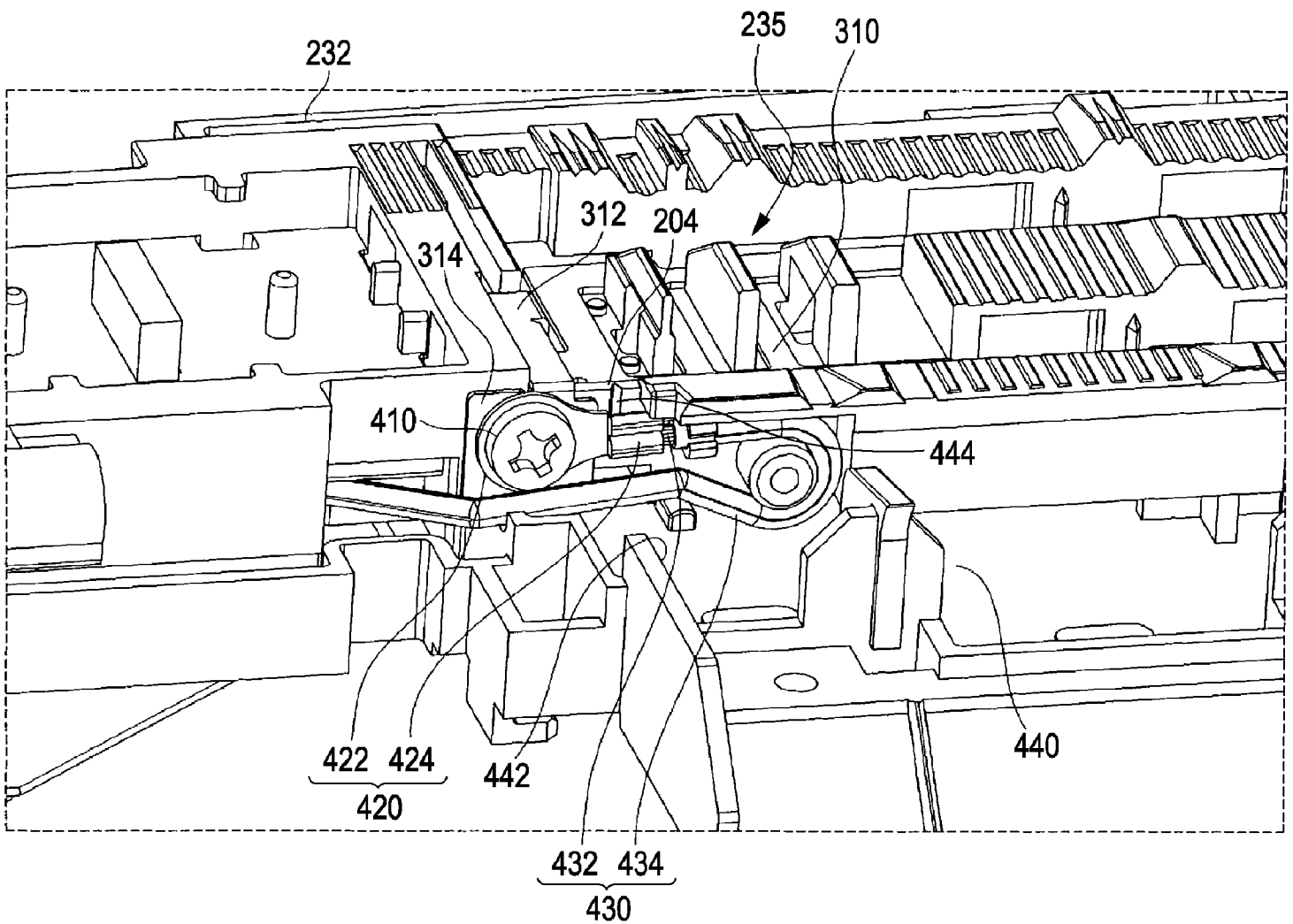
FIG. 15 is a partially enlarged perspective view that shows the shape of the platen body according to another embodiment of the invention.

FIG. 15 is a partially enlarged perspective view that shows the shape of the platen body 232 in proximity to the cutout portion 204 according to another embodiment. As shown in the drawing, the present embodiment not only includes the structure shown in FIG. 14 but also includes a guide groove 444 that is formed on the side face of the platen body 232 and extends from the cutout portion 204 to the additional accommodation member 442. In this manner, ink that has flown out from the cutout portion 204 flows smoothly along the guide groove 444 and then flows into the additional accommodation member 442. Thus, the outflow ink is reliably collected, and the crimp terminal 420, and the like, is also less smeared. In addition, because ink that has flown into the additional accommodation member 422 is held by the additional absorption member 440 that is electrically insulated from other portions, ink does not adhere to components applied with other potentials in the recording unit 110. Thus, the potential of the electrode 310 also becomes stable.

Figure 16:
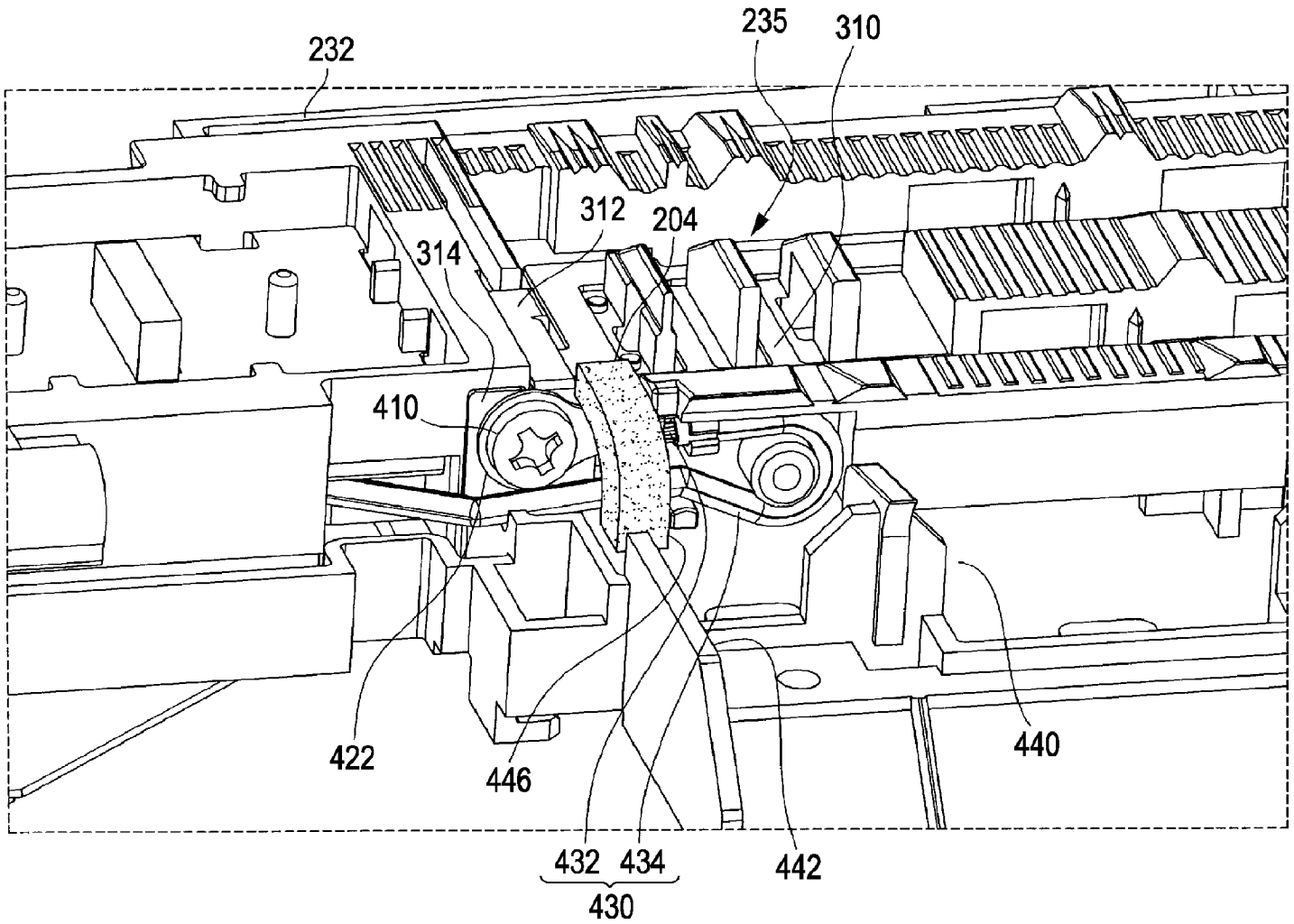
FIG. 16 is a partially enlarged perspective view that shows the shape of the platen body according to yet another embodiment of the invention.

FIG. 16 is a partially enlarged perspective view that shows the structure around the cutout portion 204 according to yet another embodiment. As shown in the drawing, the present embodiment, in addition to the structure shown in FIG. 14, includes a guide member 446, one end of which is arranged at the cutout portion 204 and the other end of which is arranged in the additional accommodation member 442. In this manner, ink that has flown out from the cutout portion 204 is absorbed from one end of the guide member 446 and flows into the additional accommodation member 442 through the other end of the guide member 446. Thus, the outflow ink is reliably collected, and the crimp terminal 420, and the like, is also less smeared. Note that, in light of the above function, the guide member 446 is formed of a porous material that easily absorbs liquid. Specifically, the material may be preferably a material that is formed by foaming a resin material, such as polyethylene or polyurethane, but the material is not limited to it.

Figure 17:
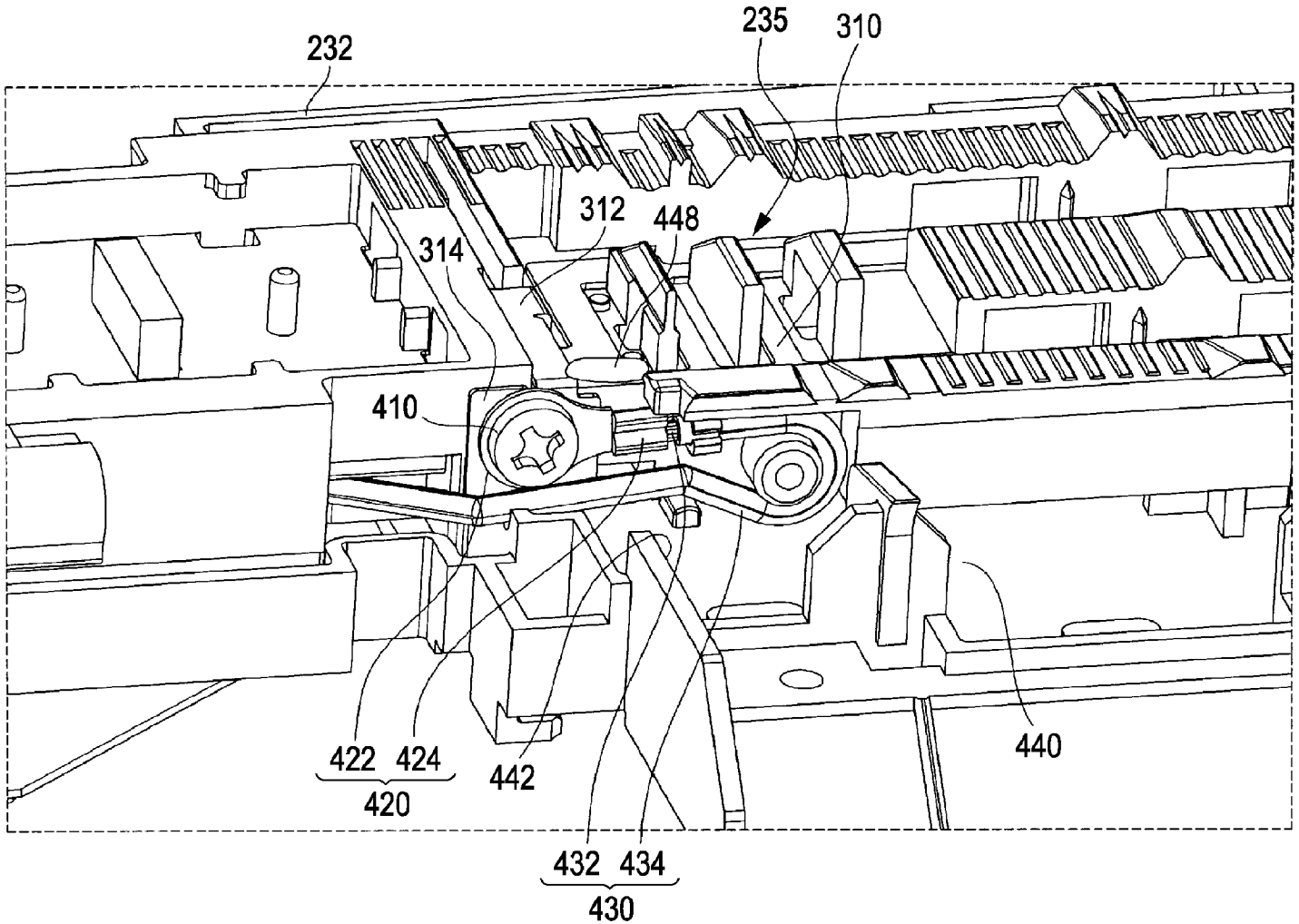
FIG. 17 is a partially enlarged perspective view that shows the shape of the platen body according to further another embodiment of the invention.

FIG. 17 is a partially enlarged perspective view that shows the structure around the cutout portion 204 according to further another embodiment. As shown in the drawing, the present embodiment, in addition to the structure shown in FIG. 14, includes a dam member 448 that seals the cutout portion 204. The dam member 448 may be, for example, easily formed by hardening a hot melt resin being adhered to the cutout portion 204.

Figure 18:
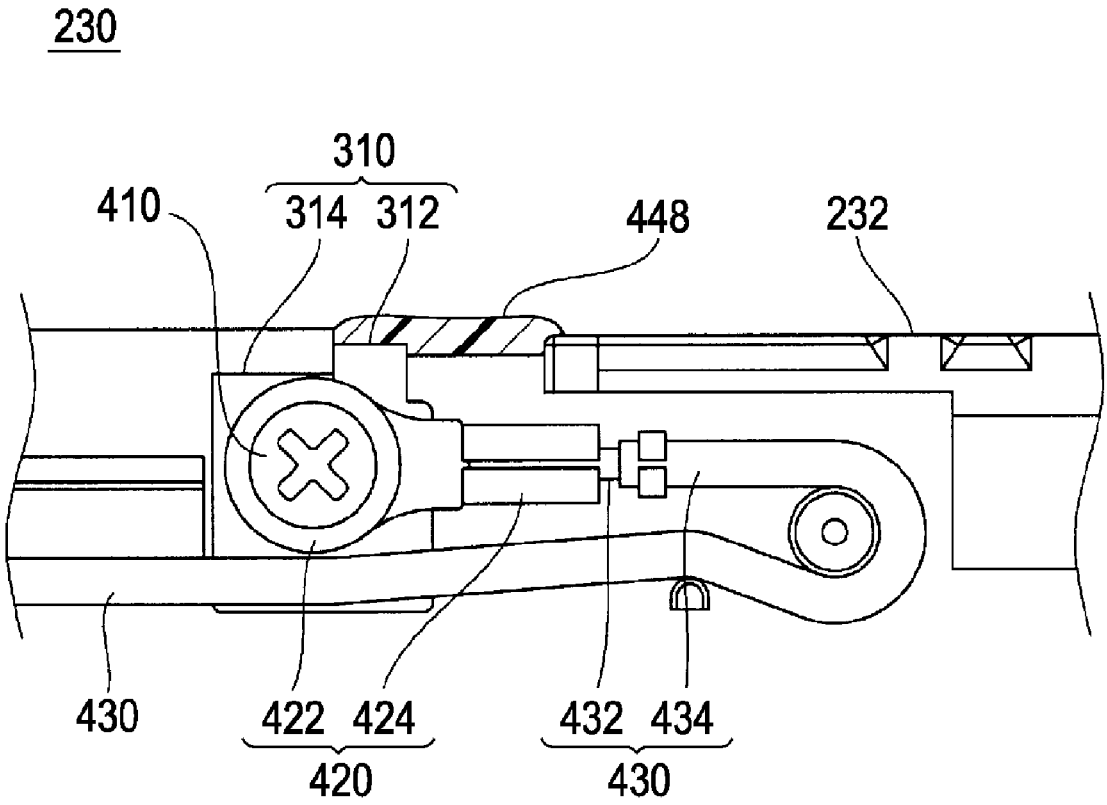
FIG. 18 is a view that shows the function of a dam member and also schematically shows the structure around the cutout portion shown in FIG. 17 as viewed from the front.

FIG. 18 is a view that shows the function of the dam member 448 and also schematically shows the structure around the cutout portion 204 shown in FIG. 17 as viewed from the front. As shown in the drawing, in the cutout portion 204, the low portion of the side wall portion 233 of the accommodation portion 235 is sealed by the dam member 448. Thus, ink does not flow out through the low portion. Note that, in another structure, a component having a shape that complements the shape of the cutout portion 204 that remains after the electrode 310 is fixed is prepared, and the component is attached to the cutout portion 204 after the attachment of the electrode 310. Thus, it is possible to form the dam member 448.

Note that the platen 230 or the platen body 232 provided with a blocking member, such as the above described additional accommodation member 442, may be supplied by manufacturing it as a single piece. In this manner, in the existing liquid ejecting apparatus that is provided with the connection cable 430 for connection with the electrode 310, by replacing a platen or a platen body with the platen 230 or the platen body 232, it is possible to give the above described function.

In addition, the ink jet recording apparatus is described as an example here. However, the liquid ejecting apparatus may include an apparatus provided with a color material ejecting head, as a liquid ejecting head, used for manufacturing a color filter for a liquid crystal display, an apparatus provided with an electrode material (conductive paste) ejecting head, as a liquid ejecting head, used for forming an electrode for an organic EL display or a field emission display (FED), an apparatus provided with a bio-organic material ejecting head and a precision pipette, as a liquid ejecting head, used for manufacturing a bio-chip. In addition, the recording object generally indicates an object to which liquid ejected from a liquid ejecting head may be adhered. The recording object may include, in addition to the sheet of recording paper, a circuit board, a disc-shaped optical recording medium, a preparation, and the like.

Furthermore, the aspects of the invention are described using the embodiments, but the scope of the invention is not limited to the embodiments described above. It is apparent to a person skilled in the art that the above embodiments may be modified into various forms. In addition, the scope of the invention also encompasses such modified embodiments and will be apparent from the appended claims.

What is claimed is:

1. A liquid ejecting apparatus, comprising:

a liquid ejecting head having a conductive nozzle plate that has openings, wherein the liquid ejecting head ejects liquid from the openings toward a front face of a recording object;

a platen that is arranged at a position opposed to the nozzle plate with the recording object placed between the platen and the nozzle plate, wherein the platen contacts a rear face of the recording object to support the recording object;

an absorption member that is arranged at a position opposed to the nozzle plate and located farther from the openings than the recording object in a direction in which the liquid is ejected, wherein the absorption member absorbs liquid that is ejected from the openings but not adhered to the recording object;

an electrode that is arranged in proximity to the absorption member and which includes a connecting portion for connecting the electrode to the platen, the connecting portion being bent upward; and a potential difference generating device that generates a difference in potential between the nozzle plate and the electrode by applying voltage to the electrode so as to form an electric field, whereby liquid ejected from the liquid ejecting head is electrically attracted toward the electrode, wherein the platen includes:

a platen body including a side wall, the connecting portion being adapted to extend upward over the side wall of the platen when the electrode is accommodated in the platen body; and an accommodation portion that is depressed from the platen body and formed to include a bottom portion and a side wall portion, wherein the accommodation portion accommodates the absorption member therein.

2. The liquid ejecting apparatus according to claim 1, wherein the blocking member is a dam member that fills the gap between the inner face of the cutout portion and the electrode.

3. The liquid ejecting apparatus according to claim 1, wherein the blocking member is an additional absorption member that is arranged in proximity to the gap between the inner face of the cutout portion and the electrode, and wherein the additional absorption portion absorbs and holds liquid that has flown out from the gap.

4. The liquid ejecting apparatus according to claim 3, wherein one end of the platen is arranged in proximity to the gap between the inner face of the cutout portion and the electrode, and the other end of the platen is arranged in proximity to the additional absorption member, and wherein the platen further includes a liquid guiding portion that guides liquid that flows out from the gap, to the additional absorption member.

5. The liquid ejecting apparatus according to claim 4, wherein the liquid guiding portion is formed of a porous material, and wherein the liquid guiding portion guides liquid by the action of capillarity.

6. The liquid ejecting apparatus according to claim 4, wherein the liquid guiding portion is a guide groove that is formed in the platen body, and wherein the guide groove guides liquid by allowing the liquid to flow along the guide groove.

7. The liquid ejecting apparatus according to claim 3, wherein the additional absorption member is electrically insulated from a portion having a potential different from a potential of the electrode in a state where the additional absorption member holds the liquid.

8. The liquid ejecting apparatus according to claim 3, wherein the electrode is attached so that the gap is placed closer to the additional absorption member.

9. The liquid ejecting apparatus according to claim 1, further comprising a blocking member that blocks liquid from flowing from the inside of the accommodation portion to the outside of the accommodation portion through a gap between an inner face of a cutout portion.

* * * * *